United States Patent [19]

Medina

[11] 4,060,292

[45] Nov. 29, 1977

[54] STORAGE BOX

[76] Inventor: Carmen Medina, P.O. Box 431, New York, N.Y. 10023

[21] Appl. No.: 706,146

[22] Filed: July 19, 1976

[51] Int. Cl.[2] ..... A47F 5/08

[52] U.S. Cl. ..... 312/247; 187/3; 248/320; 312/306

[58] Field of Search ..... 312/247, 306; 5/10 R, 5/10 B; 187/3, 4, 5; 182/142; 248/320, 317

[56] References Cited

U.S. PATENT DOCUMENTS

| | | | |
|---|---|---|---|
| 280,937 | 7/1883 | Looney | 182/142 |
| 472,469 | 4/1892 | Baum | 312/247 |
| 749,406 | 1/1904 | Spiro | 182/142 |
| 973,573 | 10/1910 | Sims | 312/247 |
| 1,518,318 | 12/1924 | Fletcher | 182/142 |
| 1,642,333 | 9/1927 | Damore | 182/142 |
| 2,499,791 | 3/1950 | Spencer | 312/247 |
| 2,576,531 | 11/1951 | Mitchell | 182/142 |
| 2,643,124 | 6/1953 | Malone | 248/317 |
| 2,915,192 | 12/1959 | Roma, Jr. | 312/247 |
| 3,627,397 | 12/1971 | Rominsky | 312/306 |

*Primary Examiner*—Paul R. Gilliam
*Assistant Examiner*—Alex Grosz
*Attorney, Agent, or Firm*—Allen D. Brufsky

[57] ABSTRACT

A ceiling mounted storage box which is reciprocable on vertical guide rails mounted on opposed walls of an enclosure. The box is raised and lowered by a rope threaded through an eyebolt attached to the ceiling. The eyebolt projects into the interior of the box. The end of the rope threaded through the eyebolt is fixed to the interior floor of the box, so by lowering or raising the rope through the eyebolt, the box is lowered or raised on the vertical guide rails.

5 Claims, 4 Drawing Figures

STORAGE BOX

BACKGROUND OF THE INVENTION

This invention relates to a ceiling mounted storage box designed to utilize space that would otherwise be wasted.

The problem of providing a sufficient amount of readily available storage space is a problem in every household, and particularly, in small apartments. Regardless of the number of clothes closets, drawers, kitchen cabinets, etc., there is always a demand for still more storage space so arranged that the contents are readily accessible.

SUMMARY OF THE INVENTION

Accordingly, this invention provides a ceiling mounted storage box which is lowerable and retractible on guides attached to adjacent walls, as for example, the walls of a hallway. The box includes a central opening receiving there through an eyebolt attached to the ceiling. A rope is threaded through a clamp in the interior of the box and the eyebolt and attached to a ring on the floor of the box. By loosening the clamp and lowering the rope, the box is lowered along the guides so that its interior is accessible for storage. To raise the box, the rope is raised and locked by the clamp when the box is adjacent the ceiling. The rope is accessible through a door hinged to the bottom of the box.

BRIEF DESCRIPTION OF THE DRAWING

Further objects and advantages of the invention will become apparent from the following description and claims, and from the accompanying drawings, wherein:

DETAILED DESCRIPTION OF THE PREFERRED EMBODIMENT

Figure 1:
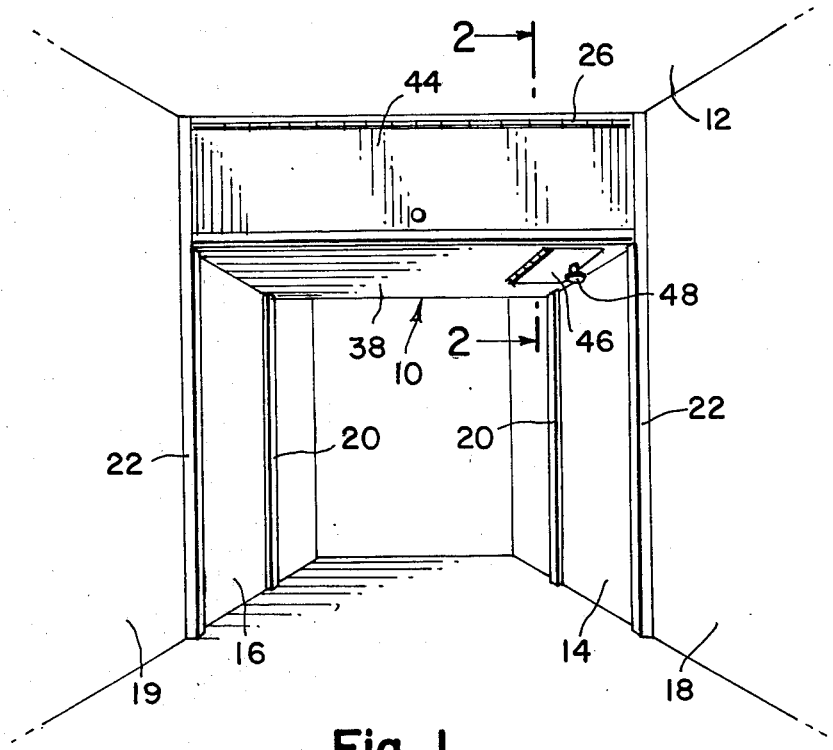
FIG. 1 is a perspective view of the storage box of the present invention is raised position adjacent a ceiling.
Figure 2:
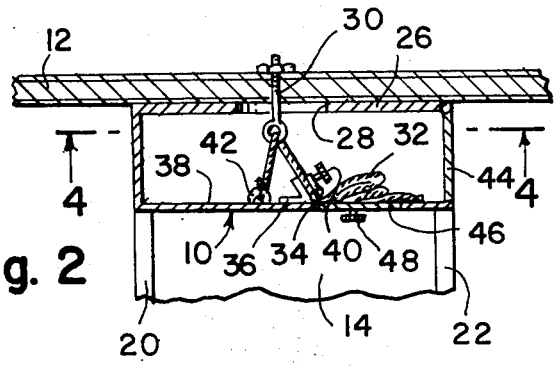
FIG. 2 is a cross-sectional view taken substantially along the plane indicated by line 2—2 of FIG. 1.
Figure 3:
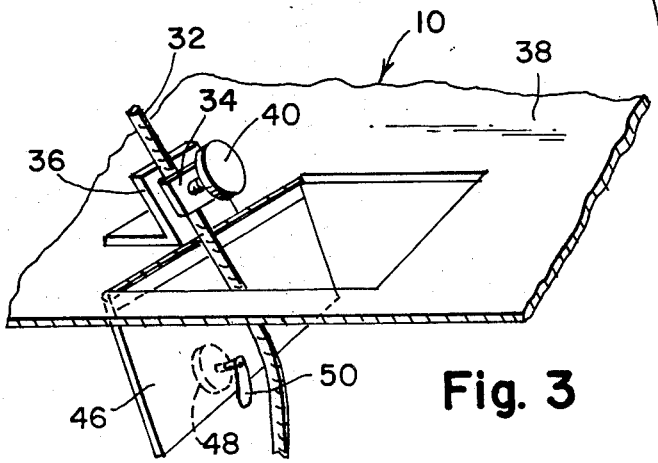
FIG. 3 is a perspective view of a portion of the box of FIG. 1.
Figure 4:
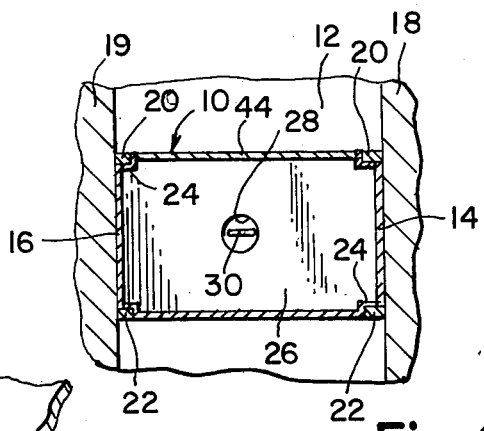
FIG. 4 is a cross-sectional view taken substantially along the plane indicated by line 4—4 of FIG. 2.

Referring now to the drawing is detail, wherein like numerals indicate like elements throughout the several views, the storage box 10 of the present invention is generally rectangular in cross-section and is mounted on a ceiling 12 between a pair of guides 14, 16 on adjacent walls 18 and 19, respectively, of a hallway or the like.

Guides 14 and 16 include a central plate having vertical rails 20 and 22 extending out of the plane of the plate at each end of the plate. Rails 20 and 22 are seated in vertical slots 24 formed in each corner of box 10.

The top surface 26 of box 10 includes a central opening 28 receiving therethrough an eyebolt 30 attached to ceiling 12. A rope 32 is threaded through a u-shaped clamp 34 mounted on an angle bracket 36 fastened to the floor 38 of box 10 within the interior of box 10. Clamp 34 is held on bracket 36 by a screw 40 threadedly connected to bracket 36. Rope 32 is threaded through clamp 34, eyebolt 30, and is attached to a ring 42 on the floor 38 of box 10.

By loosening the clamp 34 and lowering the rope 32 through eyebolt 30, the box 10 is lowered along the guide rails 20 and 22 so that the interior of the box 10 is accessible for storage through a door 44 hinged to the top surface 26 of box 10 and comprising one of its sides. To raise box 10, rope 32 is raised by pulling it through eyebolt 30 and the clamp 34 is locked to rope 32 by threading screw 40 into bracket 36 when box 10 is adjacent ceiling 12.

Rope 32 is accessible through a door 46 hinged to the bottom surface 38 of box 10 and is opened by rotating a knob 48 connected to a latch 50 which is normally seated on bottom surface 38 of box 10 to maintain the door 46 closed.

I claim:

1. A storage box construction comprising:

a substantially rectangular container in mating engagement with vertical guide rails mounted on opposed side walls of an enclosed space having a ceiling and a floor, a door mounted on said container providing access to the interior of said container, and means for raising and lowering said container from a position adjacent said ceiling to a position adjacent said floor, said means including an eyebolt extending through an aperture located in a top surface of said container, said eyebolt connected to said ceiling, a ring on the bottom interior surface of said container, a bracket on the bottom interior surface of said container, a clamp mounted on said bracket, and a rope connected to said ring and threaded in sequence through said eyebolt, and said clamp, said rope selectively threadable through the opening in which said door is mounted.

2. The box construction of claim 1 wherein said clamp is substantially u-shaped in cross-section and includes a mounting screw threadedly connected to said bracket.

3. The box construction of claim 2 including a door pivotably mounted on the bottom surface of said container for providing access to said rope.

4. The box construction of claim 3 including a rotatable latch on said door cooperating with the bottom surface of said container for locking said door.

5. The box construction of claim 1 wherein the corners of said rectangular container include vertical slots disposed therein, and vertical guide rails being seated within said vertical slots.

* * * * *